United States Patent [19]

Shieh

[11] Patent Number: 4,700,847

[45] Date of Patent: Oct. 20, 1987

[54] RETRACTILE UMBRELLA COVER AND KNOCKDOWN UMBRELLA STAND

[76] Inventor: Song-Huei Shieh, 3rd Fl., No. 558, Sec. 7 Chung-Hsiao E. Road, Taipei, Taiwan

[21] Appl. No.: 925,153

[22] Filed: Oct. 27, 1986

[51] Int. Cl.[4] ..... A47G 25/12

[52] U.S. Cl. ..... 211/62; 206/45.14

[58] Field of Search ..... 211/62, 195, 60.1, 68, 211/67, 69, 70.4; 206/214, 45.19, 45.14, 443

[56] References Cited

U.S. PATENT DOCUMENTS 710,790 10/1902 Magerhans ..... 211/62

1,462,615 7/1923 Noble ..... 211/62

*Primary Examiner*—Ramon S. Britts

*Assistant Examiner*—Sarah A. Lechok Eley

*Attorney, Agent, or Firm*—Lowe, Price, LeBlanc, Becker & Shur

[57] ABSTRACT

A structure of retractile umbrella cover and knockdown umbrella stand comprising a box body composed of an upper and a lower box elements, two holder elements, a plurality of supporting stands, cross fasteners and umbrella covers. Each box element upon incorporation with a holder element, some supporting stands and cross fasteners can form an umbrella stand unit, and a plurality of such units can be used in combination by means of connection with connectors for placing of umbrellas in umbrella covers, on hanging of them on stubs on the holder elements. Bottom of the umbrella cover is used to keep water dropped from umbrella. The present invention can be knocked down and have its components kept in the box body which is small in volume and easy in storage as well as carriage since the box is designed with handle for such purpose.

5 Claims, 6 Drawing Figures

RETRACTILE UMBRELLA COVER AND KNOCKDOWN UMBRELLA STAND

BACKGROUND OF THE INVENTION

The present invention relates to an umbrella stand, particularly an umbrella stand with knockdown structure each unit can be used alone, or a plurality of such units can be used in combination. The said umbrella stand can be knocked down and have it components kept in a box which is small in volume and requires only a small space for storage. It is a novel structure of knockdown umbrella stand.

SUMMARY OF THE INVENTION

The present invention provides a retractable or collapsible, knockdown umbrella stand which includes a pair of boxes with retainers and handles. Two holder elements with retaining rings and upwardly extending stubs are also provided which are dimensioned to fit each within a box when the stand is collapsed. Collapsible vertical supports are also provided which when the stand is assembled extend between the base or bottom of a box and its respective holder element and which may be separated into individual rod members which are dimensioned to fit within the respective box when the stand is collapsed. A plurality of telescoping, cylindrical umbrella cover members are also provided. Each member has a large end adapted to fit within a retaining ring in one of the holder elements and a smaller closed end adapted to be releasably mounted on the bottom of one of said boxes. Each cover is adapted to receive an umbrella when a stand is assembled or to collapse to a length sufficient to fit within the box when the stand is collapsed. Each box element upon incorporation with holder element, supporting stands, umbrella covers and some cross fasteners can form an umbrella stand unit, and further using of connectors to connect two such units can form an umbrella stand for keeping of umbrellas, and knocing down of them allows keeping of its components within a box body.

DESCRIPTION OF THE PREFERRED EMBODIMENT

Figure 1:
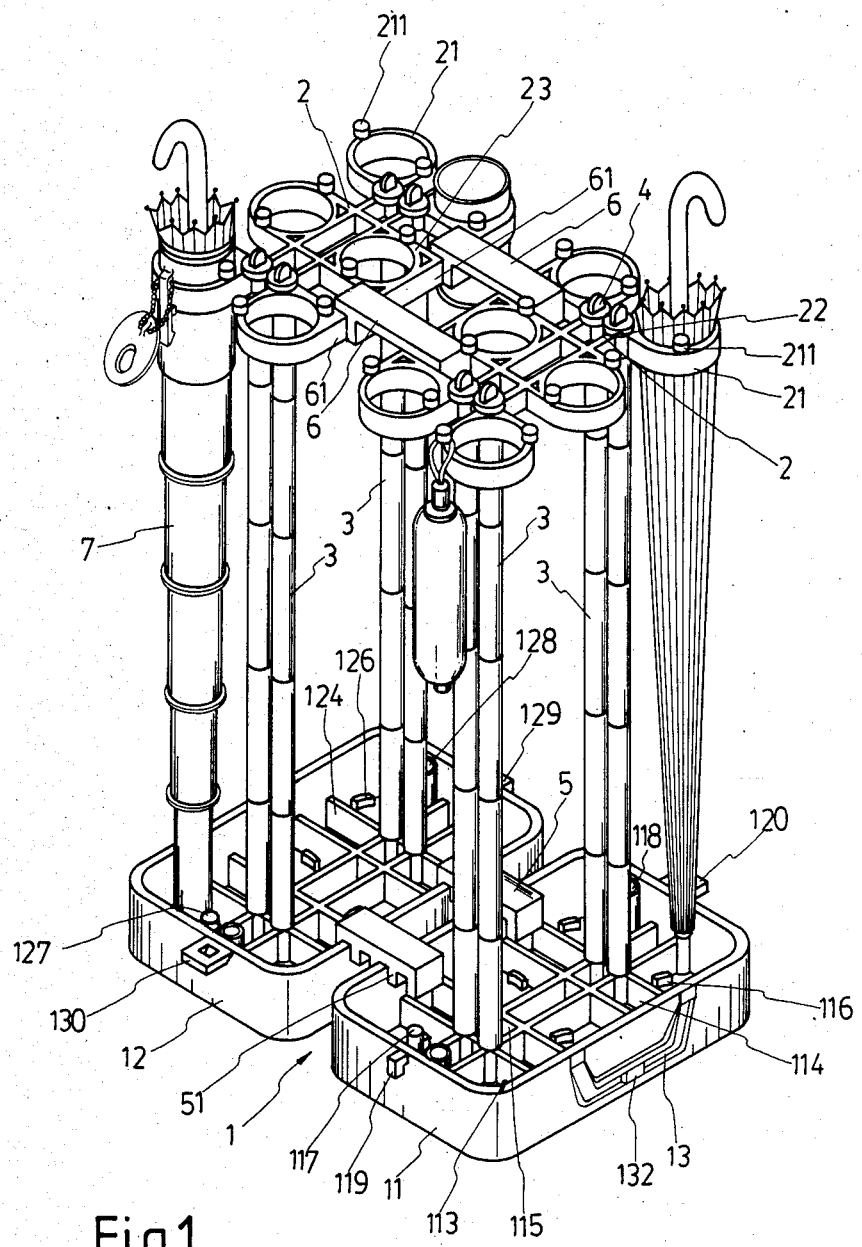
FIG. 1 is a perspective view of an embodiment of a knockdown umbrella stand with retractile umbrella cover according to the present invention.
Figure 2:
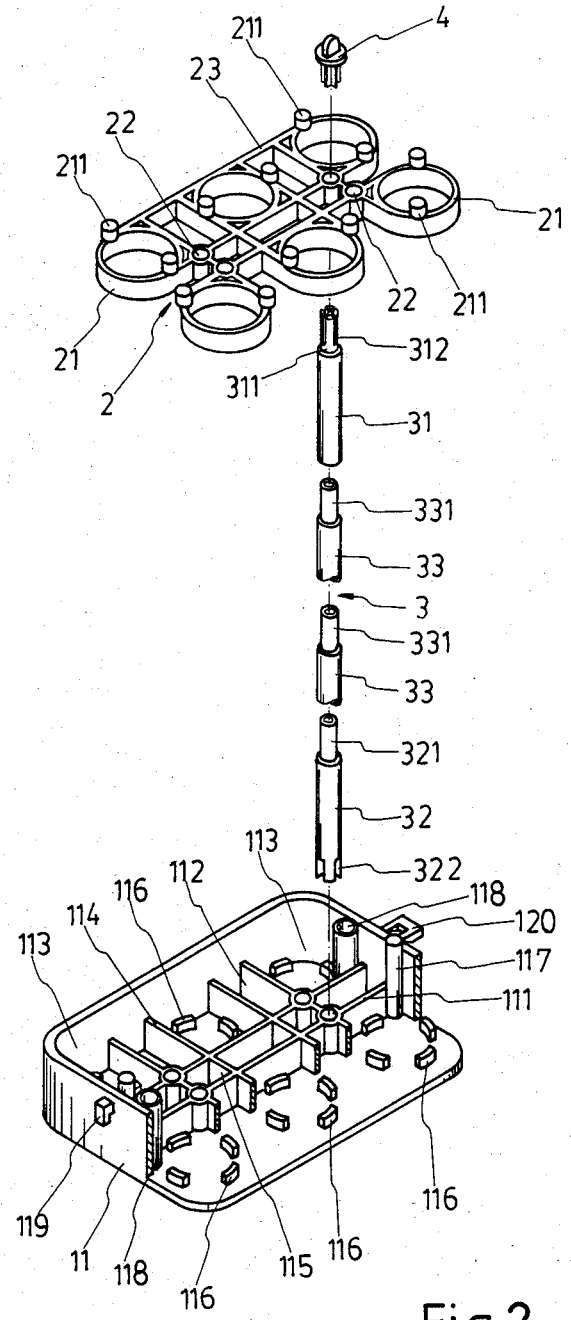
FIG. 2 is a perspective and fragmental view of an umbrella stand according to the present invention.
Figure 3:
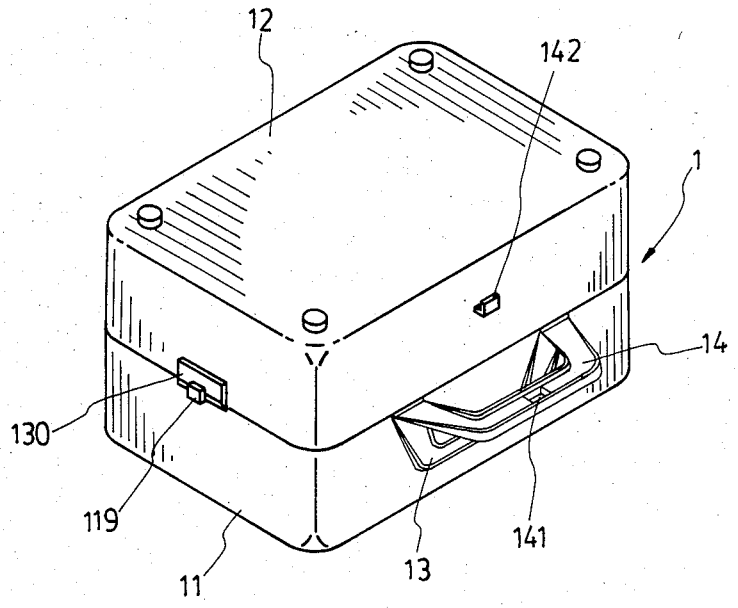
FIG. 3 is a perspective view of a box body according to the present invention.

FIG. 1 is a perspective view of an embodiment of a knockdown umbrella stand with retractile umbrella cover according to the present invention. FIG. 2 is a prespective and fragmental view of an umbrella stand according to the present invention. FIG. 3 is a perspective view of a box body according to the present invention. The present invention is composed of a box body (1), two holder elements (2), a plurality of supporting stands (3), a plurality of cross fasteners (4), and a plurality of connectors (5 and 6). The box body (1) is composed of an upper and a lower box elements (11 and 12) of identical structure. Each of the box elements (11 and 12), with appropriate holder element (2) and cross fasteners (4), can form an independent stand, and assembly of two independent stands by means of the connectors (5 and 6) can form an umbrella stand according to the present invention. Structure of the present invention is described with reference to only a stand as shown in FIG. 2. Inner side of a box element (11) is partitioned to a plurality of spaces (113, 114, 115) of different sizes by means of a plurality of intersecting partitioning boards (111 and 112). Among them the largest spaces (113) are installed with retainers (116) for retaining umbrella covers (7). The second largest spaces (114) and the small spaces (115) are designed for containing the supporting stands (3), cross fasteners (4) and connectors (5 and 6) during closing of the box body (1). The longitudinal partitioning boards (111) at both sides of the upper box element (11) have tenons (117) and mortises (118) along their external sides. of the lateral side of the upper box element (11) has a male fastener (119) and the other has a female fastener (120). The upper and lower box elements (11 and 12) can be fixed together by menas of connection of the tenon (117) to the mortise (128), the tenon (127) to the mortise (118), the male fastener (119) to the female fastener (130), and the male fastener (129) to the female fastener (120). A side of the upper box element (11) has a handle (13) with an opening (131) for retaining by a retainer (132) above it. The holder element (2) is a structure with a plurality of umbrella cover retaining rings (21) each with two stubs (211). Each of the retaining rings (21) can hold an umbrella cover (7) for placing of an umbrella. The holder element (2) has a lateral bar (23) along a side. The stubs (211) can be used to hang folded umbrellas directly. There are some mortises (22) in the holder element (2) for fixing of supporting stands (3). Each supporting stand (3) is composed of an upper core barrel (31), a lower barrel (32) and a plurality of intermediate core barrels (33). Each of the upper, lower and intermediate core barrels (31, 32 and 33) has a joint flange (311, 321 or 331) for connecting to another core barrel. Key ways (312, 322) are made on the joint flange (311) on the upper barrel (31) and the bottom of the lower barrel (32) for incorporating the supporting stand (3) and mortise (22) of the holder element (2) to the upper box element (11). The connectors (5) are for jointing the upper and lower box elements (11 and 12) with their recess holes (51). The connectors (6) are for jointing two holders (2) by placing across two lateral bars (23). The cross fasteners (4) are for fixing the holder elements (2) by incorporating with the key ways (312) after the joint flange (311) of the supporting stand (3) has passed through the holder element (2).

While the present invention is used as a stand, the handles (13 and 14) on the upper and lower box elements (11 and 12) have their respective openings (131 and 141) retained by the retainers (132 and 142). The handles (13 and 14) are used to ease handling after the upper and lower box elements (11 and 12) are assembled to form a box body (1).

Figure 4:
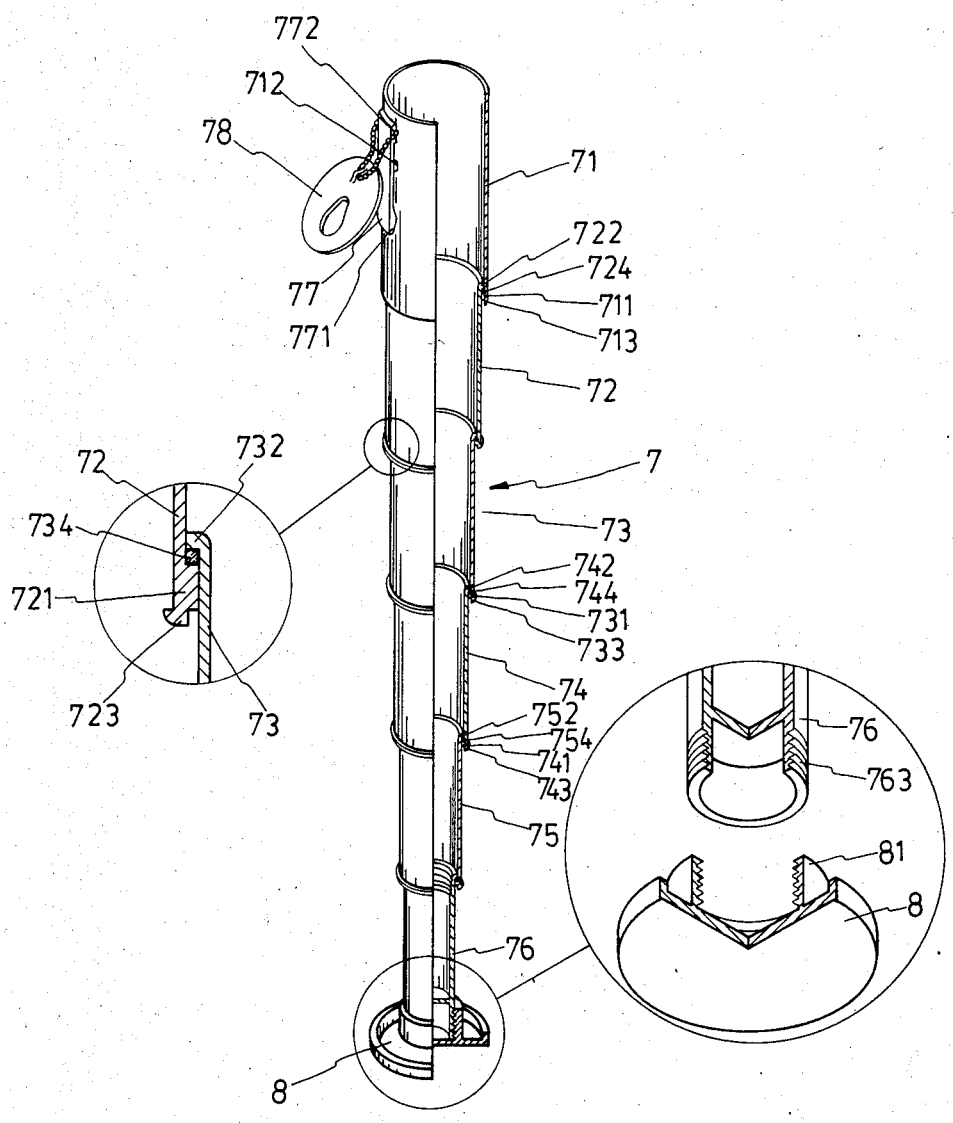
FIG. 4 is a perspective and sectional view of an umbrella cover in extension condition according to the present invention.
Figure 5:
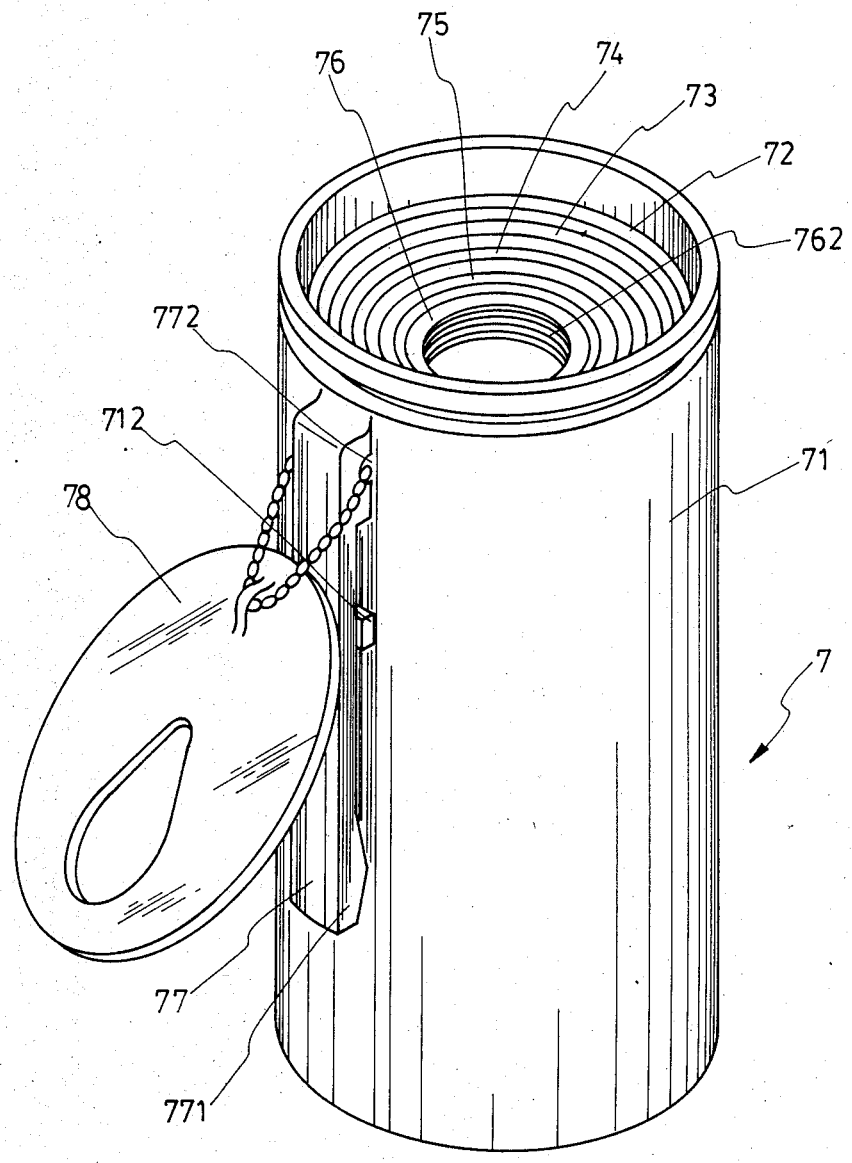
FIG. 5 is a perspective view of the umbrella cover in retracted condition according to the present invention.

FIG. 4 is a perspective and sectional view of an umbrella cover in extension condition according to the present invention. FIG. 5 is a perspective view of the umbrella cover in retracted condition according to the present invention. The umbrella cover (7) according to the present invention mainly comprises of a plurality of hollow circular pipes (71, 72, 73, 74, 75 and 76) of different diameters. The pipe (71) which has the largest diameter is incorporated with an inner ring (711) at the bottom, and the pipe (76) which has the smallest diameter is incorporated with an outer ring (761) on the top. Each of the intermediate pipes (72, 73, 74 and 75) has an inner ring (721, 731, 741 or 751) at the bottom and an outer ring (722, 732, 742 or 752) on the top. By interconnection of adjacent inner and outer rings, two adjacent pipes are moveably connected together in a manner that no pipe may disengage from its larger and adjacent pipe. In order to prevent falling of the smaller pipe into larger pipe which may make extension of the smaller pipe difficult, flanges (723, 733, 743 and 753) are designed at the bottoms of the pipes (72, 73, 74 and 75) respectively in a manner that such flanges will stop on the bottom of their respective larger and adjacent pipes. For instance, the flange (723) of the second largest pipe (72) will lay on the bottom of the largest pipe (71) while it is retracting into the largest pipe (71), and this design will prevent falling of the second largest pipe (72) into the largest pipe (71) which makes extension difficult. Connection between other pipes will not be described here because it is identical to that between the pipes (71) and (72). In order to make the umbrella cover (7) watertight, each of the pipes (72, 73, 74 and 75), except the largest pipe (71), has a lead-proof gasket (724, 734, 744, 754 and 764) below their respective outer rings (722, 732, 742, 752 and 762) in a manner that each leak-proof gasket is located between the inner wall of a pipe and outer wall of its smaller pipe, such as between the inner wall of the largest pipe (72) to provide good water tightness effect and to prevent leakage of water from seam of the cover when umbrella is kept in it.

The largest pipe (71) according to the present invention has a hanging bracket (77) at the upper end. An end of the hanging bracket (77) is made in the form of a raised race (771). A nose (712) is formed on the surface of the largest pipe (71) at a position corresponding to the hanging bracket (77). The nose (712) and the raised face (771) divide the hanging bracket into two control spaces. When the control space is applied to fix the hanging bracket (77) to a retaining ring (21), position of the largest pipe (71) is adjustable by placing the retaining ring (21) between the nose (712) and the raised face (771), or between the nose and a retaining hole (772) of the hanging bracket (77) and thus the weight of the umbrella cover (7) become adjustable. The retaining hole (772) is for holding a cover plate (78) of the umbrella cover (7).

The smallest pipe (76) has inner thread at its upper end and a closed lower end so that the umbrella cover (7) is a hollow structure with a closed end to keep water content when wet umbrella is kept in it and thus no water will leak to contaminate ground or floor on which it is placed. Outer thread (763) is made on the bottom of the smallest pipe (76) to fit the inner thread (81) on a cover plate (8) for screwing the cover plate (8) to the smallest pipe (76) so that after retracting the umbrella cover the cover plate (8) can cover the other pipes (72, 73, 74, 75 and 76) in the largest pipe (71).

Figure 6:
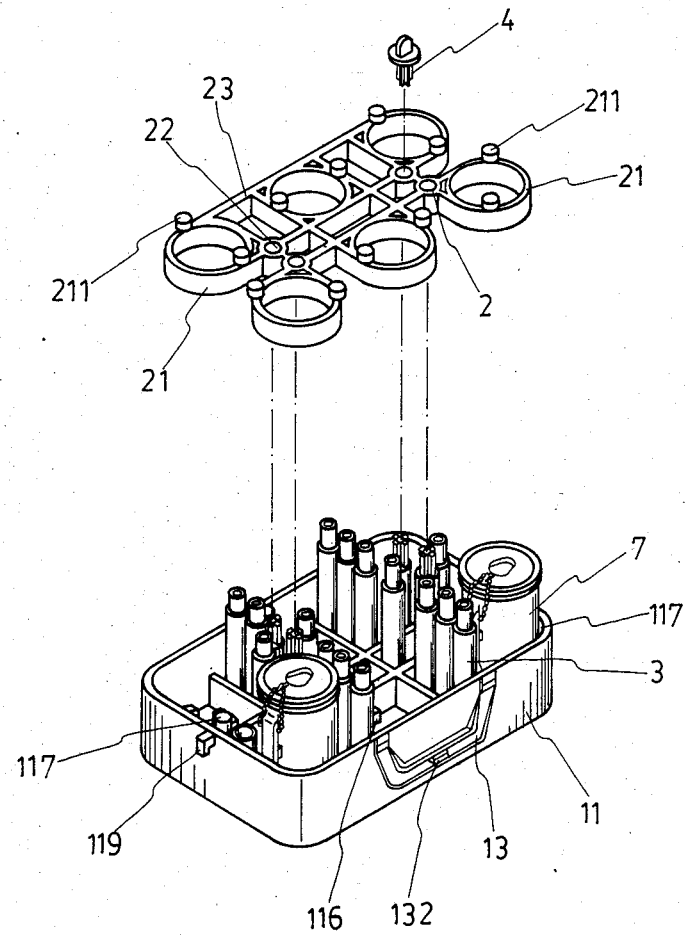
FIG. 6 is a perspective partial exploded view illustrating one half of the stand of this invention collapsed.

FIG. 6 is a perspective and exploded partial view illustrating keeping of knockdown components in the box body according to the present invention. For knocking down the stand according to the present invention, the cross connectors (4), connectors (5 and 6), holder elements (2) and supporting stands are separated from each other, the umbrella covers (7) are retracted and fixed in the box element (11). Then, barrel elements of the supporting stands (3), cross fasteners (4), connectors (5 and 6) are placed within the second largest spaces (114) and the small spaces (115), the holder elements (2) are placed on the partitioning boards (111) and (112), the other box element (12) is fixed to the box element (11) by connecting the connecting the mortise (128) and tenon (127) to the tenon (117) and mortise (118), and finally the male fasteners (119 and 129) are secured to the female fasteners (120 and 130) to secure the box elements (11 and 12) to form a box (1) which is portable by holding the handles (13 and 14).

I claim:

1. A collapsible knockdown umbrella stand comprising:

opposed, rectangular first and second boxes, each having a bottom wall and upstanding side walls; partition means disposed within each box defining separate compartments including a plurality of large compartments disposed along a pair of opposed walls; retaining means disposed on the bottom of each large compartment for releasably retaining the end of a cylindrical umbrella holder;

releasable fastening means carried by said boxes for attaching the upper surfaces of said side walls to form a closed container when the stand is collapsed and handle means on the exterior surface of each of said boxes for carrying said closed container;

a pair of holder elements, each mounting a plurality of umbrella cover retaining rings, each adapted to be disposed over and spaced above an open box when said stand is assembled, each ring disposed over a respective large compartment and each element dimensioned to fit within a box when said stand is collapsed, each element mounting a plurality of upstanding stubs whereby when said stand is assembled, folded umbrellas may be hung from said stubs;

a plurality of collapsible vertical support means for interconnecting each element and spacing said element above a respective box when said stand is assembled and for collapsing to a length sufficient to fit within said box when said stand is collapsed;

a plurality of cylindrical, telescoping umbrella covers, each having a large open end dimensioned to fit within a retaining ring of one of said elements and a small closed end adapted to be retained in a corresponding large compartments in one of said boxes when said stand is assembled, and adapted to telescope to a dimension sufficient to fit within said closed container when said stand is collapsed; and connecting means releasably interconnecting said boxes and said elements at a side thereof when said stand is assembled and for fitting within a box when said stand is collapsed.

2. The stand of claim 1 wherein said vertical support means further comprises a plurality of elongated rod members, each member having a male end and a female end adapted to be slidably received within one another whereby a plurality thereof may be assembled to form a plurality of vertical supports;

first mounting means carried by each box for releasably mounting one end of each support therein; and second mounting means cooperable with each respective element for releasably mounting an opposite end at said element.

3. The stand of claim 1 wherein said connecting means is adapted to be retained in said boxes when said stand is assembled so that two individual stands are provided.

4. The stand of claim 1 further comprising sealing means disposed within each cover for rendering each cover leak proof when said stand is assembled.

5. The stand of claim 1 further comprising attachment means mounted adjacent the large end of each cover for releasably attaching said cover to a respective ring when said stand is assembled.

* * * * *